US007056051B2

(12) United States Patent
Fiffie

(10) Patent No.: US 7,056,051 B2
(45) Date of Patent: Jun. 6, 2006

(54) INFLATABLE DEVICE FOR DISPLAYING INFORMATION

(76) Inventor: Artiss J. Fiffie, 230 Tennett St., Prov, RI (US) 02908

( * ) Notice: Subject to any disclaimer, the term of this patent is extended or adjusted under 35 U.S.C. 154(b) by 0 days.

(21) Appl. No.: 10/462,274

(22) Filed: Jun. 16, 2003

(65) Prior Publication Data

US 2004/0253042 A1 Dec. 16, 2004

(51) Int. Cl.
*B43K 29/00* (2006.01)

(52) U.S. Cl. ..... 401/195; 40/905

(58) Field of Classification Search ..... 401/195, 401/52; 137/231, 233; 138/93; 40/358, 40/905; 446/220, 224
See application file for complete search history.

(56) References Cited

U.S. PATENT DOCUMENTS

| | | | | |
|---|---|---|---|---|
| 614,749 | A * | 11/1898 | Pallas | 138/93 |
| 1,776,182 | A * | 9/1930 | Cook | 446/220 X |
| 3,576,374 | A | 4/1971 | Lite | |
| 3,892,081 | A * | 7/1975 | Goral | 446/220 X |
| 3,961,852 | A | 6/1976 | Parry | |
| 4,350,458 | A | 9/1982 | Murahara et al. | |
| 4,381,615 | A | 5/1983 | Lonsmin | |
| 4,673,007 | A | 6/1987 | Huang | |
| 4,798,016 | A | 1/1989 | Venditti et al. | |
| 5,000,599 | A | 3/1991 | McCall et al. | |
| 5,080,652 | A * | 1/1992 | Sancoff et al. | 604/132 |
| 5,083,881 | A | 1/1992 | Yoshinaga | |
| 5,086,577 | A | 2/1992 | Abernethy | |
| 5,308,179 | A | 5/1994 | Whitright | |
| 5,340,227 | A | 8/1994 | D'Andrade | |
| 5,443,322 | A * | 8/1995 | Jozat et al. | 401/195 X |
| 5,544,437 | A | 8/1996 | Lanoie | |
| 5,603,454 | A * | 2/1997 | Knapp et al. | 239/17 |
| 5,927,881 | A | 7/1999 | Yang | |
| 6,039,492 | A | 3/2000 | Chen | |
| 6,045,281 | A | 4/2000 | Bunn et al. | |
| D447,172 | S | 8/2001 | Cohen | |
| 6,283,657 | B1 | 9/2001 | Vann | |
| D464,674 | S | 10/2002 | deHaseth | |
| 6,722,705 | B1 * | 4/2004 | Korkor | 285/332 |

FOREIGN PATENT DOCUMENTS

| | | | |
|---|---|---|---|
| NL | 1009951 C2 * | 2/2000 | 401/195 |

* cited by examiner

*Primary Examiner*—David J. Walczak
(74) *Attorney, Agent, or Firm*—Burns & Levinson, LLP; Frederick C. Williams; Kimberly B. Whitehead

(57) ABSTRACT

A device for advertising, display of information, personalized messages, and the like. A flexible wall section contains displayed information, can be mechanically inflated and deflated, and can form three dimensional images. The device may be attached to any shaft-like object, including a writing instrument that is capable of use for writing. The flexible wall section is removable so that other information may be displayed on the device.

7 Claims, 3 Drawing Sheets

INFLATABLE DEVICE FOR DISPLAYING INFORMATION

CROSS-REFERENCE TO RELATED APPLICATIONS (Not Applicable)

STATEMENT REGARDING FEDERALLY SPONSORED RESEARCH OR DEVELOPMENT (Not Applicable)

INCORPORATION-BY-REFERENCE OF MATERIAL SUBMITTED ON A COMPACT DISC (Not Applicable)

REFERENCE TO A "MICROFICHE APPENDIX"

(Not Applicable)

BACKGROUND OF THE INVENTION

1) Field of the Invention

The present invention relates to a device that provides for advertising, display of information, personalized messages, and the like. In addition, the device contains flexible walls that contain such information and can be inflated and deflated. More particularly, the device may be attached to any shaft-like object. In preferred embodiments, the device will be attached to a writing instrument that is capable of use for writing.

2). Description of the Related Art Including Information Disclosed Under 37 CFR 1.97 and 1.98

For being attractive or displaying a message, a writing instrument is usually decorated with patterns or messages on the barrel or writing instrument cap. The barrel of a writing instrument usually has a rigid surface for the convenience of being held and for containing the writing instrument's internal mechanical parts. Therefore, the surface of a writing instrument can be decorated with only planar or nearly planar patterns.

The planar pattern on a writing instrument is not particularly eye-catching. Therefore, it is preferable to have a 3-dimensional pattern on a writing instrument. One solution is to attach an inflatable unit at the tail end of the barrel, i.e. the non-writing end. The inflatable unit would contain the information, personalized messages, and the like and display the same when inflated. The inflatable unit may also be attached to the end of any shaft-like instrument.

It is therefore an object of the present invention to provide an improved inflatable display device that may be attached to a writing instrument, cake topper or any other shaft-like object.

BRIEF SUMMARY OF THE INVENTION

The present invention is an improved inflatable display device that provides for advertising, displaying information or personalized messages, and the like. In addition, the device contains flexible walls that contain such information and can be inflated and deflated.

The device includes a hollow sleeve having an open top, a sidewall with at least one air hole therein, and an open bottom. The hollow sleeve is placed within a balloon having an open top and an open bottom, wherein seals are formed between the top of the sleeve and the top of the balloon and between the bottom of the sleeve and the bottom of the balloon. Located at the bottom of the sleeve is a junction configured to form a seal at the bottom of the sleeve. Located at the top of the sleeve is a valve assembly configured so that when closed it forms a seal at the top of the sleeve and when opened air can either be forced through the valve assembly and into the sleeve forcing the balloon to expand or it can be forced out of the sleeve and through the valve assembly allowing the balloon to contract.

In preferred embodiments, either a writing instrument or any shaft-like object can be attached to the junction at the bottom of the sleeve. In another preferred embodiment, the balloon can be configured to form three dimensional images of various shapes and sizes.

BRIEF DESCRIPTION OF THE SEVERAL VIEWS OF THE DRAWINGS

The above and other objects, features, and advantages will become more readily apparent from the following description, reference being made to the accompanying drawings in which.

IDENTIFICATION OF ITEMS IN THE FIGURES

FIG. 1

1—junction
3—spring
4—sleeve
7—air inlet
15—inflatable display device

FIG. 2

1—junction
2—balloon
3—spring
4—sleeve
5—valve
6—tail

7—air inlet
15—inflatable display device

Figure 1:
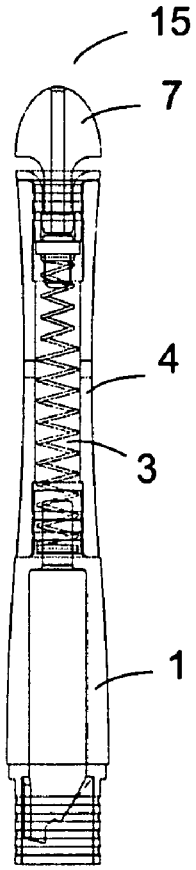
FIG. 1 is an orthogonal schematic side view of the inflatable display device according to the present invention.
Figure 3A:
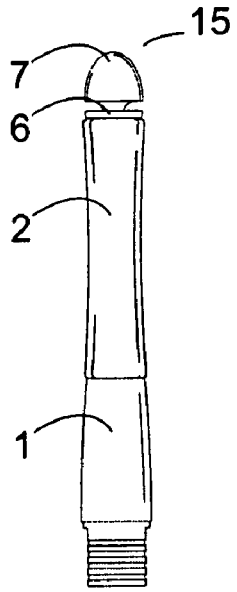
FIG. 3A is an orthogonal side view of the inflatable display device in an uninflated condition.
Figure 4A:
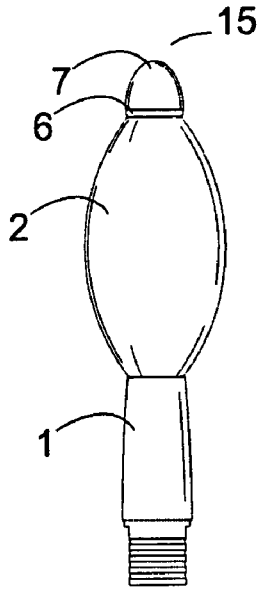
FIG. 4A is an orthogonal side view of the inflatable display device in a semi-inflated condition.
Figure 5A:
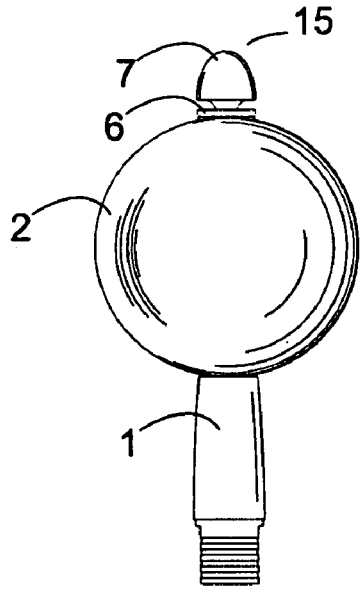
FIG. 5A is an orthogonal side view of the inflatable display device in an inflated condition.
Figure 3B:
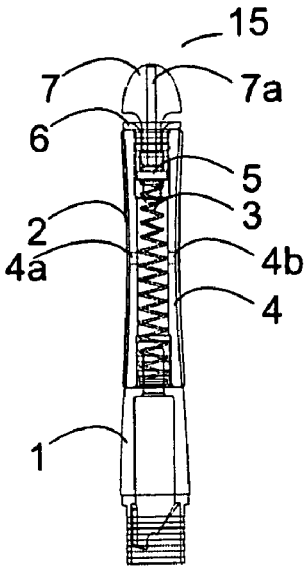
FIG. 3B is an orthogonal schematic cross-sectional side view of the inflatable display device in an uninflated condition.
Figure 4B:
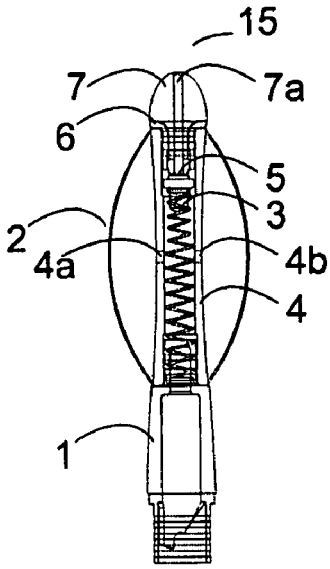
FIG. 4B is an orthogonal schematic cross-sectional side view of the inflatable display device in a semi-inflated condition.
Figure 5B:
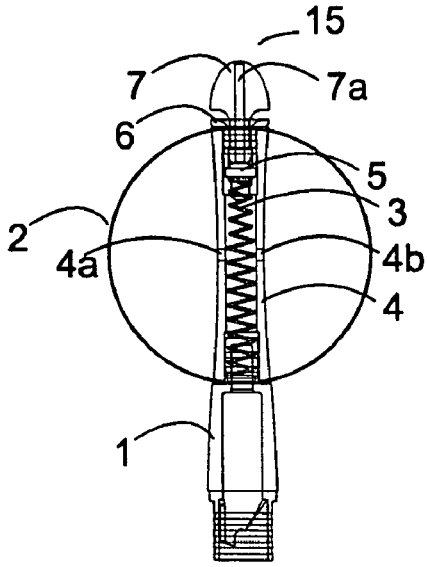
FIG. 5B is an orthogonal schematic cross-sectional side view of the inflatable display device in an inflated condition.
Figure 6:
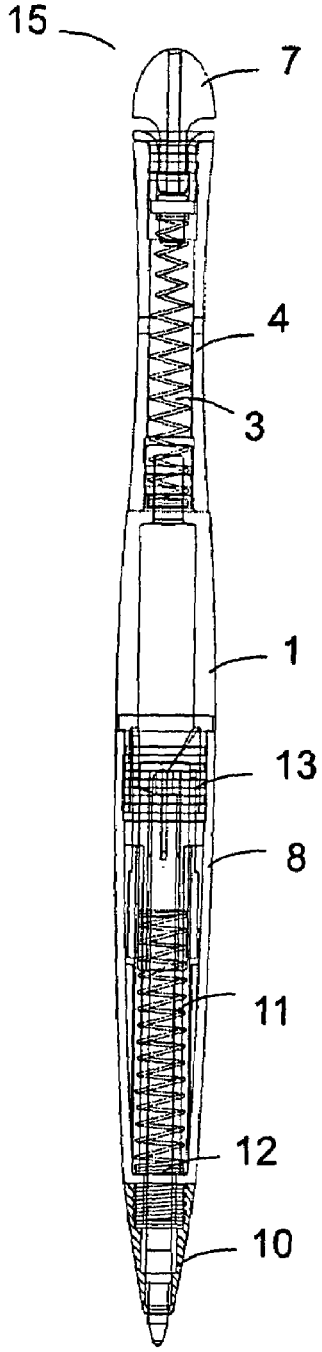
FIG. 6 is an orthogonal schematic side view of the inflatable display device on a writing instrument according to the present invention.
Figure 7:
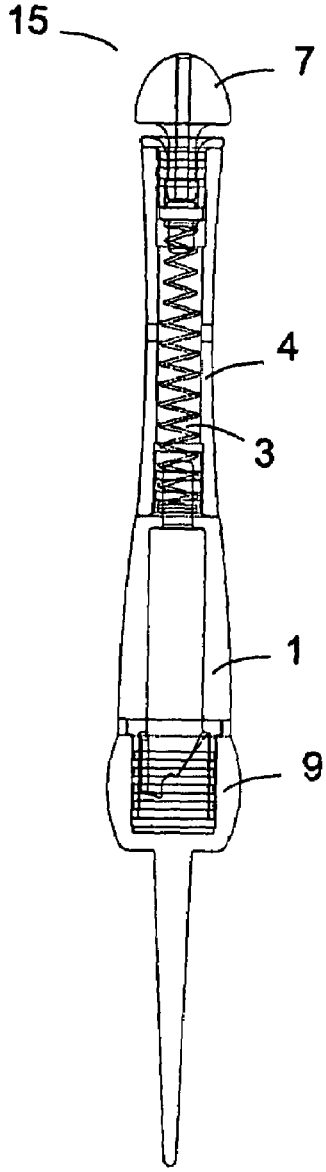
FIG. 7 is an orthogonal schematic side view of the inflatable display device on a shaft-like object according to the present invention.

FIG. 3A
1—junction
2—balloon
6—tail
7—air inlet
15—inflatable display device FIG. 3B
1—junction
2—balloon
3—spring
4—sleeve
4*a*—air hole
4*b*—air hole
5—valve
6—tail
7—air inlet
7*a*—air inlet hole
15—inflatable display device FIG. 4A
1—junction
2—balloon
6—tail
7—air inlet
15—inflatable display device FIG. 4B
1—junction
2—balloon
3—spring
4—sleeve
4*a*—air hole
4*b*—air hole
5—valve
6—tail
7—air inlet
7*a*—air inlet hole
15—inflatable display device FIG. 5A
1—junction
2—balloon
6—tail
7—air inlet
15—inflatable display device FIG. 5B
1—junction
2—balloon
3—spring
4—sleeve
4*a*—air hole
4*b*—air hole
5—valve
6—tail
7—air inlet
7*a*—air inlet hole
15—inflatable display device FIG. 6
1—junction
3—spring
4—sleeve
7—air inlet
8—pen barrel
10—tip cone
11—pen spring
12—refill
13—pen mechanism
15—inflatable display device FIG. 7
1—junction
3—spring
4—sleeve
7—air inlet
9—shaft-like attachment
15—inflatable display device

DETAILED DESCRIPTION OF THE INVENTION

The present invention relates to a device that provides for advertising, display of information, personalized messages, and the like. In all embodiments of the invention, the device contains flexible walls that contain such information and can be inflated and deflated. The device may be attached to any shaft-like object, including a writing instrument that is capable of use for writing.

Figure 2:
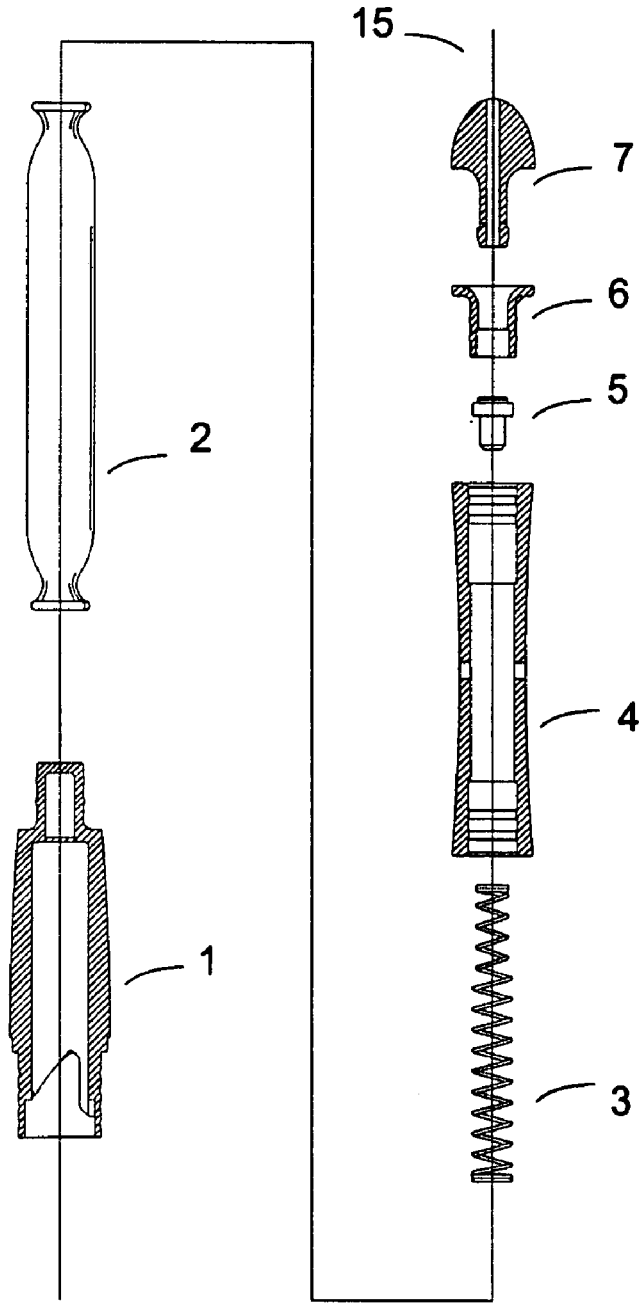
FIG. 2 is an exploded orthogonal schematic cross-sectional side view of the inflatable display device showing the relational arrangement of the components.

FIG. 1 is an orthogonal schematic side view of the inflatable display device 15 while FIG. 2 is an exploded orthogonal schematic cross-sectional side view of the inflatable display device 15 showing the relational arrangement of the components. Referring to FIGS. 1 and 2, the inflatable display device 15 consists of a junction 1 molded from plastic with threads at its tail end to allow attachment to any shaft-like instrument, which is not shown. Alternatively, any other form of attaching means may be utilized, such as the materials being force fitted, snapped together, glued, etc.

The balloon 2 is made from any elastic, synthetic material such as rubber or latex. The sleeve 4 is formed of metal, molded plastic or any other suitable material and is inserted and centered within the balloon 2. The lower end of the balloon 2 is pinched tightly between junction 1 and the sleeve 4 to form a seal, while the upper end of the balloon 2 is pinched tightly between the tail 6 and the sleeve 4 to form a seal. The tail 6 is also formed of metal, molded plastic or any other suitable material. The spring 3 fits within the sleeve 4 with its lower end engaging junction 1 and its upper end engaging valve 5 and forcing it against the tail 6 creating an air tight seal. The air inlet 7 is slidably coupled to the tail 6. When the air inlet 7 is depressed, it causes the spring 3 to depress and the air tight seal between valve 5 and tail 6 to be broken, allowing the balloon 2 to be inflated or deflated.

FIG. 3A is an orthogonal side view of the inflatable display device 15 in an uninflated condition while FIG. 3B is an orthogonal schematic cross-sectional side view of the inflatable display device 15 in an uninflated condition. The air inlet 7 contains an air inlet hole 7*a* and sleeve 4 contains air holes 4*a* and 4*b*. The air holes may be of any number, shape or size. Also, the balloon 2 is placed around the sleeve 4 and is sealed at the lower and upper ends, as previously described. These figures show the upper end of spring 3 engaged with and forcing valve 5 against the tail 6 creating an air tight seal.

FIG. 4A is an orthogonal side view of the inflatable display device 15 in a semi-inflated condition while FIG. 4B is an orthogonal schematic cross-sectional side view of the inflatable display device 15 in a semi-inflated condition. These figures show the air inlet 7 in a depressed state, which allows air to be either blown by mouth or mechanically pumped through the air inlet hole 7*a*. Depressing air inlet 7 also opens valve 5 and allows air to travel between valve 5 and tail 6 and into the central portion of sleeve 4. The air then travels through air holes 4*a* and 4*b* forcing the balloon 2 to expand.

FIG. 5A is an orthogonal side view of the inflatable display device 15 in an inflated condition while FIG. 5B is an orthogonal schematic cross-sectional side view of the inflatable display device 15 in an inflated condition. These figures depict the balloon 2 in a fully inflated condition and the upper end of spring 3 engaged with and forcing valve 5 against the tail 6 creating an air tight seal.

One embodiment of the present invention is depicted in FIG. 6. This is an orthogonal schematic side view of the inflatable display device 15 on a writing instrument according to the present invention. The junction 1 is attached to the barrel 8 of a pen or any other writing instrument. The writing instrument portion is found in the prior art and would typically comprise a tip cone 10 fastened to the barrel 8, which in turn houses a pen spring 11, a refill 12 and a turning mechanism 13.

Another embodiment of the present invention is shown in FIG. 7. This is an orthogonal schematic side view of the inflatable display device on a shaft-like object. In this embodiment, the junction 1 is attached to a shaft-like attachment 9.

While the invention has been described in combination with embodiments thereof, it is evident that many alternatives, modifications and variations will be apparent to those skilled in the art in light of the foregoing teachings. Accordingly, the invention is intended to embrace all such alternatives, modifications and variations as fall within the spirit and scope of the appended claims.

The invention claimed is:

1. A writing instrument combined with an inflatable device that provides for advertising, display of information or personalized messages comprising:

a. a hollow sleeve having an open top, a sidewall with at least one air hole therein, and an open bottom;

b. a balloon having an open top and an open bottom, said balloon being configured to fit around said sleeve;

c. a seal between the top of the sleeve and the top of the balloon and a seal between the bottom of the sleeve and the bottom of the balloon;

d. a valve assembly connected to the top of the sleeve, said valve assembly being configured so that when closed it forms a seal at the top of the sleeve and when opened air can be forced through said valve assembly and into said balloon forcing said balloon to expand;

e. a junction comprising a top portion and a bottom portion, said junction top portion is connected to the bottom of the sleeve and forms a seal at the bottom of the sleeve; and f. a writing instrument connected to said junction bottom portion.

2. The device of claim 1 wherein the sleeve has a generally cylindrical shape.

3. The device of claim 1 wherein the connection between said writing instrument and said junction bottom portion comprises threads.

4. The device of claim 1 wherein the valve assembly is further configured so that when opened air can be forced through said valve assembly and out of said balloon allowing said balloon to contract.

5. The device of claim 4 wherein the balloon may be expanded and contracted more than once.

6. The device of claim 1 wherein the external surface of said balloon comprises at least one form of indicia selected from the group consisting of letters, words, and designs.

7. The device of claim 1 wherein said balloon is further configured to form a three dimensional image.

* * * * *